US005797814A

United States Patent [19]

Janes et al.

[11] Patent Number: 5,797,814

[45] Date of Patent: Aug. 25, 1998

[54] RETENTION DEVICE FOR SPORTS RACQUETS, ESPECIALLY FOR RACQUETBALL RACQUETS

[75] Inventors: Richard Janes, Burlington Township, N.J.; Stephen J. Davis, Washington Crossing, Pa.

[73] Assignee: Prince Sports Group, Inc., Bordentown, N.J.

[21] Appl. No.: 645,465

[22] Filed: May 10, 1996

[51] Int. Cl.[6] ..... A63B 49/00

[52] U.S. Cl. ..... 473/551; 473/553; 473/464

[58] Field of Search ..... 473/551, 549, 473/553, 464, 422, 461, 463, 183; 224/219, 222, 267; 280/819, 821; 441/75, 59; 2/17, 170; 16/114 R, 114 A, 114 B, DIG. 24, DIG. 25

[56] References Cited

U.S. PATENT DOCUMENTS

| | | | |
|---|---|---|---|
| 2,728,501 | 12/1955 | Hill | 224/219 |
| 3,858,881 | 1/1975 | Hurwitz | 473/553 |
| 3,931,656 | 1/1976 | Thomson | 441/75 |
| 4,026,549 | 5/1977 | Gunn | 473/464 X |
| 4,159,792 | 7/1979 | Siegal | 224/267 |
| 4,247,975 | 2/1981 | Robinson | 473/551 |
| 4,315,641 | 2/1982 | Larsen | 224/219 X |
| 4,322,077 | 3/1982 | Van't Hof | 473/551 |
| 4,479,785 | 10/1984 | Tugwood et al. | 441/75 |
| 4,591,156 | 5/1986 | Attenni | 473/551 |
| 4,865,239 | 9/1989 | Timbrook | 224/267 |
| 4,958,758 | 9/1990 | Tipple et al. | 224/267 |
| 5,058,524 | 10/1991 | Guthrie, Jr. | 224/267 X |
| 5,476,257 | 12/1995 | Bobby | 473/464 |
| 5,549,329 | 8/1996 | Wuerslin et al. | 280/821 |

FOREIGN PATENT DOCUMENTS

| | | | |
|---|---|---|---|
| 85/01664 | 4/1985 | WIPO | 473/183 |

*Primary Examiner*—Raleigh Chiu
*Attorney, Agent, or Firm*—White & Case L.L.P.

[57] ABSTRACT

A retention device for use with an object having a handle, such as a racquetball racquet, comprises a wrist ring for securing the device about a wrist of a person gripping the handle, an elastomeric connecting member, and a securing means remote from said ring for securing said device to a handle. In one preferred embodiment, the ring and connecting member are elastomeric loops linked together. Alternatively, the ring and connecting member may be a unitary piece formed of elastomeric material, and the securing means is in the form of a loop portion or other securing means at the remote end of the connecting member. The connecting loop or loop portion are preferably secured by a pin inside the butt of the racquet handle.

17 Claims, 8 Drawing Sheets

RETENTION DEVICE FOR SPORTS RACQUETS, ESPECIALLY FOR RACQUETBALL RACQUETS

FIELD OF INVENTION

The present invention relates to objects having a handle, where it is desirable to secure the object to the wrist. The invention, has particular application to racquetball racquets.

BACKGROUND OF THE INVENTION

In the game of racquetball, it is often necessary to attempt to hit shots which are very near one of the walls or floor of the court. Impact with the floor or wall, or even perspiration on the racquet handle, can cause the player to lose his or her grip while swinging the racquet. In order to prevent the racquet from flying loose and possibly injuring the opposing player, racquetball racquets are provided with a wrist cord, one end of which is attached to the racquet handle and the other end of which loops around the player's wrist. In addition to its safety function, if the racquet slips the cord allows the player to re-grip the handle and continue play. Typically, a cross-pin is secured inside the handle at the butt end, and the wrist cord is tied to the cross-pin.

In addition to hitting the floor or wall while swinging the racquet, racquetball players are apt to dive to the floor to make shots. Thus, there can be a considerable impact on the racquet. As a result, the typical racquetball wrist cord is made of a relatively strong material, e.g. nylon, which can withstand a total tensile force of about 95 kg.

The conventional wrist cord has little or no give. This can restrict the movement of the player's hand when, in the course of play, it tries to move in a way which is different from the standard alignment between the hand and the racquet grip. Also, when the racquet hits the floor or wall, or hits the other player or the other player's racquet, force is applied to the wrist cord, and the only part which can "give" is the player's hand and wrist, which must absorb the full force of the impact.

SUMMARY OF THE INVENTION

The present invention is a retention device which is intended to replace the conventional wrist cord on racquetball racquets. The retention device may also be used with other objects having handles, where it is desirable to prevent such object from accidently falling or flying loose.

More particularly, a retention device according to the invention comprises a first securing means for securing the device about the wrist of a person gripping the racquet, a connecting member connected to the first securing means, and a second securing means remote from the first securing means for securing the connecting means to the handle. At least the connecting member is elastic.

Preferably, the first securing means is an elastic wrist ring sized to fit about the user's wrist. In one embodiment, the connecting member is an elongated, elastic member coupled to the wrist ring. Preferably, the connecting member is in the shape of an elongated loop, having curved opposite ends, one of which engages the wrist ring and the other of which forms the second securing means. The latter end is preferably looped around a pin inside the butt of the handle, although other means of securing the connecting member to the handle may be employed.

In another embodiment, the wrist ring and connecting portion are formed as a unitary piece from elastomeric material and the second securing means is in the form of an opening at the end of the connecting member.

In either embodiment, the device is preferably formed of silicone rubber, Kraton®, or natural rubber. In the most preferred embodiment, the loop or other connecting member has a length greater than 65 mm, a tensile strength less than 48 kg; a spring constant less than 100 kg/m, and most preferably less than 50 kg/m at a pull force of 5.0 kg; and an elongation greater than 20%, and most preferably greater than 100%, of its unstretched length at 5 kg pull force.

The retention device preferably has a breakaway strength which is substantially lower than conventional wrist cords, but a significantly higher ability to elongate at relatively low pull force. Whereas a typical wrist cord has a tensile strength of approximately 95 kg, the retention device according to the invention preferably has a much lower break strength. Due to its substantial extensibility, the racquet handle can move easily away from the hand upon impact with an object. The amount of force transmitted to the hand tends to be reduced, and is more uniformly imparted due to the "give" associated with the connecting member, avoiding the distracting rise and fall of tension applied to the player's hand and wrist. The "give" associated with the retention device will ensure that high tensile forces are not applied to the wrist and hand, and moreover will ensure that such forces are applied more gradually than in the case of conventional wrist cords. As a result, the device is more comfortable to wear and, due to the reduced tension, the player is less likely to notice the presence of the device, or feel any constraint in movement as in the case of a conventional wrist cord.

The extensibility of the device also allows the tensile strength to be reduced compared to conventional wrist cords, without adversely affecting the function of preventing the racquet from flying loose. At the same time, in the event of a severe impact where excessive force is transmitted to the wrist, due to the fact that the device will break above a predetermined force, impact forces on the wrist are cushioned, and the chance of serious wrist injury is reduced. The elastomeric retention device thus reduces the possibility of wrist and hand injuries while playing, when impact with the floor, wall, or other player's racquet forces the racquet handle to move away from the player's hand.

For a better understanding of the invention, reference is made to the following detailed description of a preferred embodiment, taken in conjunction with the drawings accompanying the application.

DETAILED DESCRIPTION OF PREFERRED EMBODIMENTS

Figure 1:
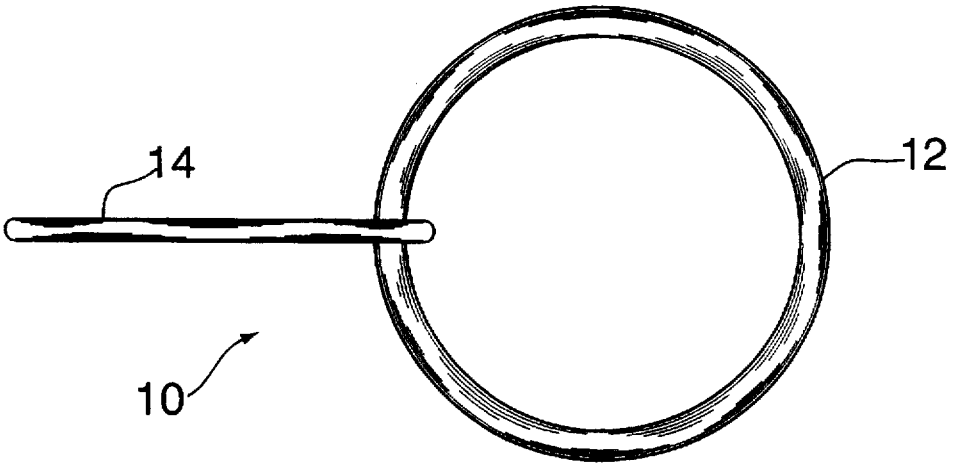
FIG. 1 is a top view of a retention device according to the invention.
Figure 2:
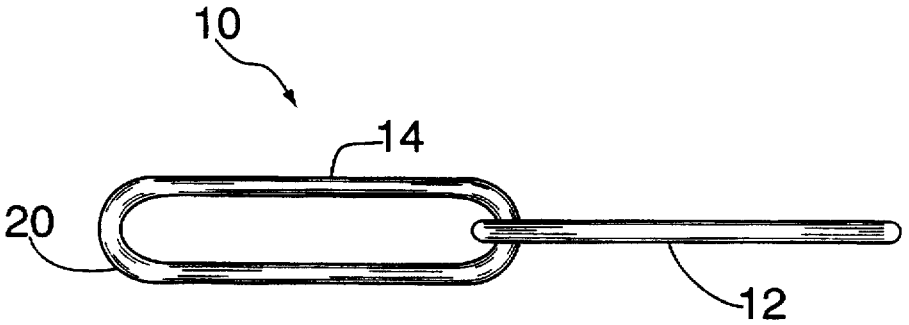
FIG. 2 is a side view of the device.
Figure 3:
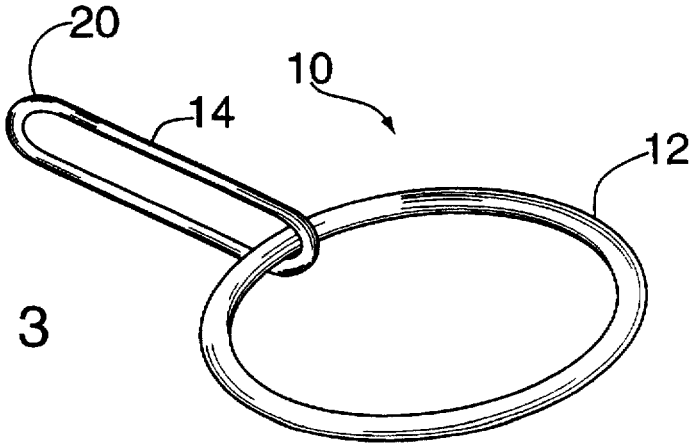
FIG. 3 is a perspective view of the device.

Referring to FIGS. 1–3, a first preferred embodiment of a retention device 10 according to the invention comprises a first securing means, in the form of a wrist ring 12, for securing the device about the wrist of a person gripping the handle, and a connecting member 14 in the form of a loop extending from the wrist ring 12. The connecting member 14 includes a pair of parallel straight sections, connected at each end by a curved section in the shape of half a ring. The wrist ring 12 and connecting member 14 are linked together, so that they are free to move relative to one another.

Figure 4:
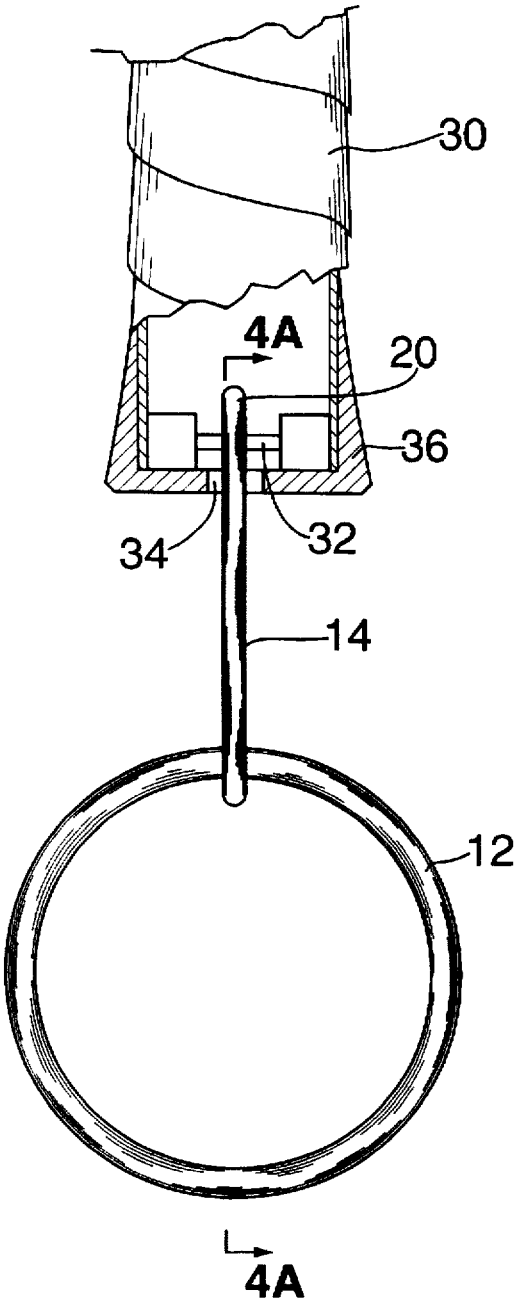
FIG. 4 is a top view of the device, which has been secured to a racquetball racquet handle, the latter shown partly in section.
Figure 4A:
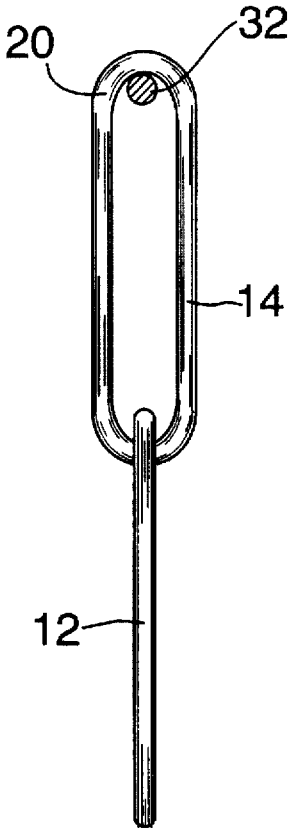
FIG. 4*a* is a side view of the connecting pin of the racquet, shown in section, and of the connecting member, taken in the direction of arrows 4*a*—4*a* of FIG. 4.
Figure 4B:
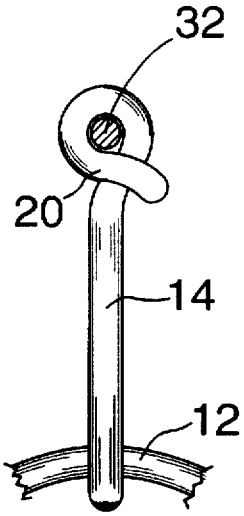
FIG. 4*b* is a side view, comparable to FIG. 4*a*, of an alternative means of securing the device.

The ring 12 is sized to fit about the user's wrist, and preferably has a round cross-section. As shown in FIGS. 4–4*a*, the outer loop portion 20 of the connecting member 14 is secured to the handle 30 of, e.g., a racquetball racquet, by inserting a pin 32 therethrough, the pin 32 in turn being secured inside the end of the handle 30 in a manner known. Alternatively, as shown in FIG. 4*b*, the outer loop portion 20 of the connecting member may be secured to the handle by looping it around the pin 32. The latter is the more preferable embodiment, because it allows the pin 32 to be secured within the handle during racquet manufacture and the retention device to be attached later. This also facilitates replacing the retention device later if desired. In either embodiment, the connecting member 14 extends through an opening 34 in the butt cap 36 of the racquet, to extend generally axially relative to the racquet.

Figure 4C:
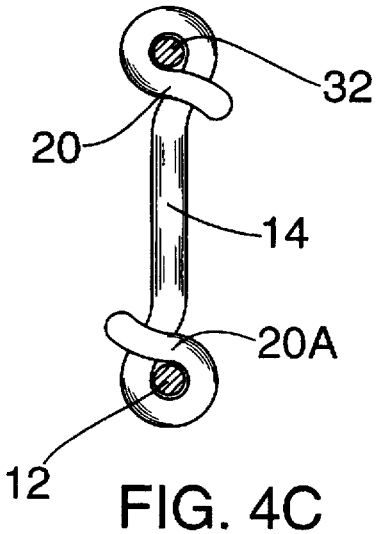
FIG. 4*c* is a side view, comparable to FIGS. 4*a* and 4*b*, of a modification of the device of FIGS. 4*a*–4*b*.

FIG. 4*c* shows a further modification in which the wrist ring 12 and connecting member 14 are coupled by looping the near loop portion 20*a* of the connecting member 14 about the wrist ring 12. The outer loop portion 20 may be looped around the pin 32 in the same manner as FIG. 4*b*, or may receive the pin 32 in the manner shown in FIG. 4*a*. The embodiment of FIG. 4*c* offers the advantage that the ring 12 and connecting member 14 may be molded separately, which facilitates ease of manufacturing. The ring 12 and connecting member 14 may be made of the same material or of different materials. Ring 12 is preferably elastic, and preferably has a round cross-section to allow it to be rolled onto the wrist, but it may have other cross-sectional shapes and/or may be formed of a non-elastic material, such as a conventional nylon chord or a hard material such as hard plastic.

Figure 5:
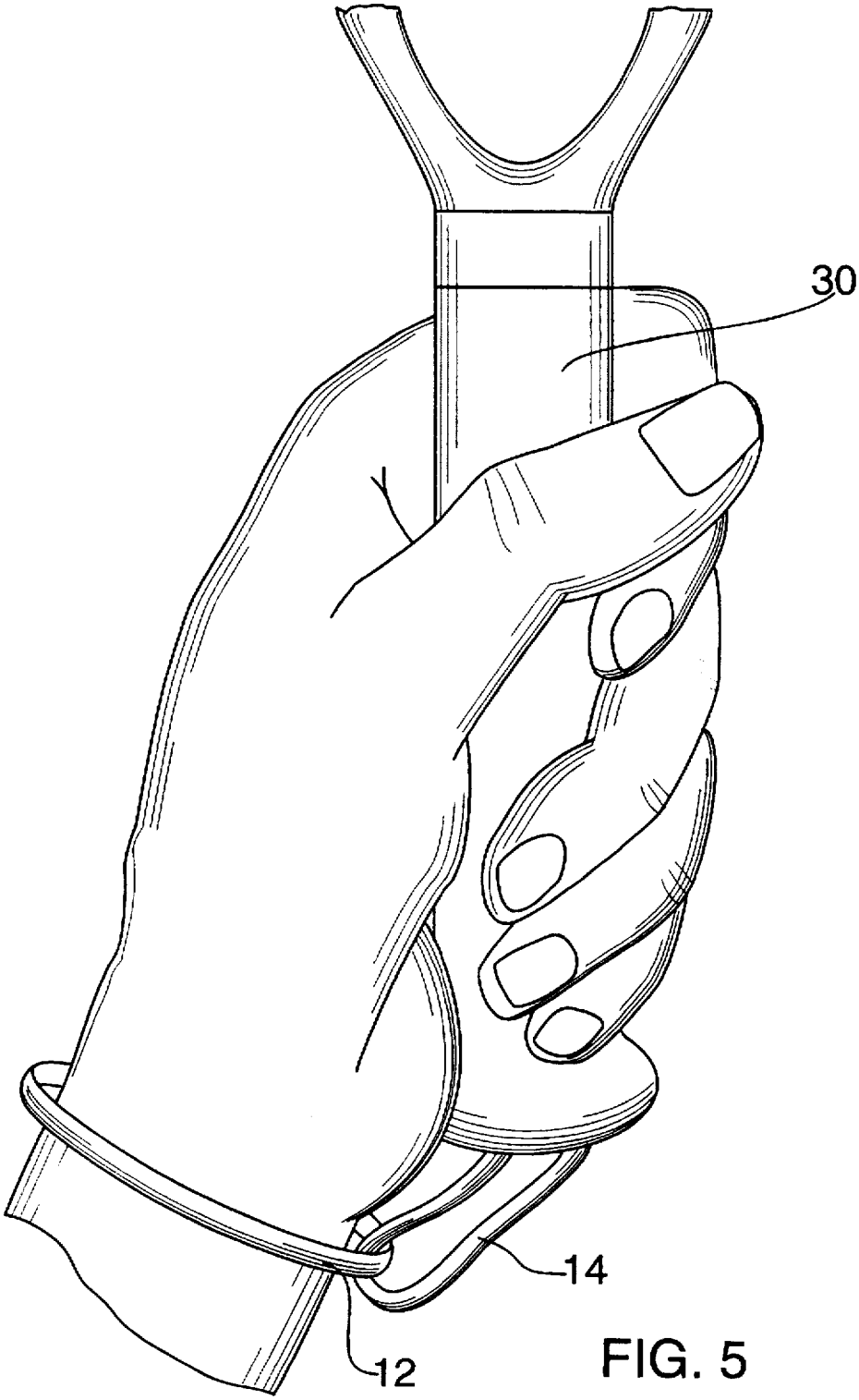
FIG. 5 illustrates a racquetball handle with the device secured about the wrist of the player.

As shown in FIG. 5, in order to use the device, the player inserts his or her wrist through the wrist ring 12, so that the retention device is retained securely on the wrist. Because the wrist ring is separate from the connecting member, it may be rolled onto the wrist without tangling and, once the wrist ring is on the player's wrist, the player's hand is free to grasp the racquet handle 30. Also, because the connecting member 14 is flexible, and because the two links 12, 14 are free to rotate relative to one another, the player's hand has a relatively large amount of freedom of movement.

In an illustrative embodiment, the wrist ring 12 is round in cross-section, has an interior radius of approximately 39 mm, and a cross sectional diameter of approximately 5 mm. The connecting member 14 has an unstretched length of approximately 83 mm, a cross-sectional diameter of approximately 4 mm, and an interior radius of curvature at each end of approximately 4.4 mm.

Preferably, the ring 12 and connecting member 14 are formed by molding an elastomeric material, such as a silicone or natural (gum) rubber. An illustrative compression molding process for making the first embodiment of the invention from silicone rubber will now be described with reference to FIGS. 6–9.

Figure 6:
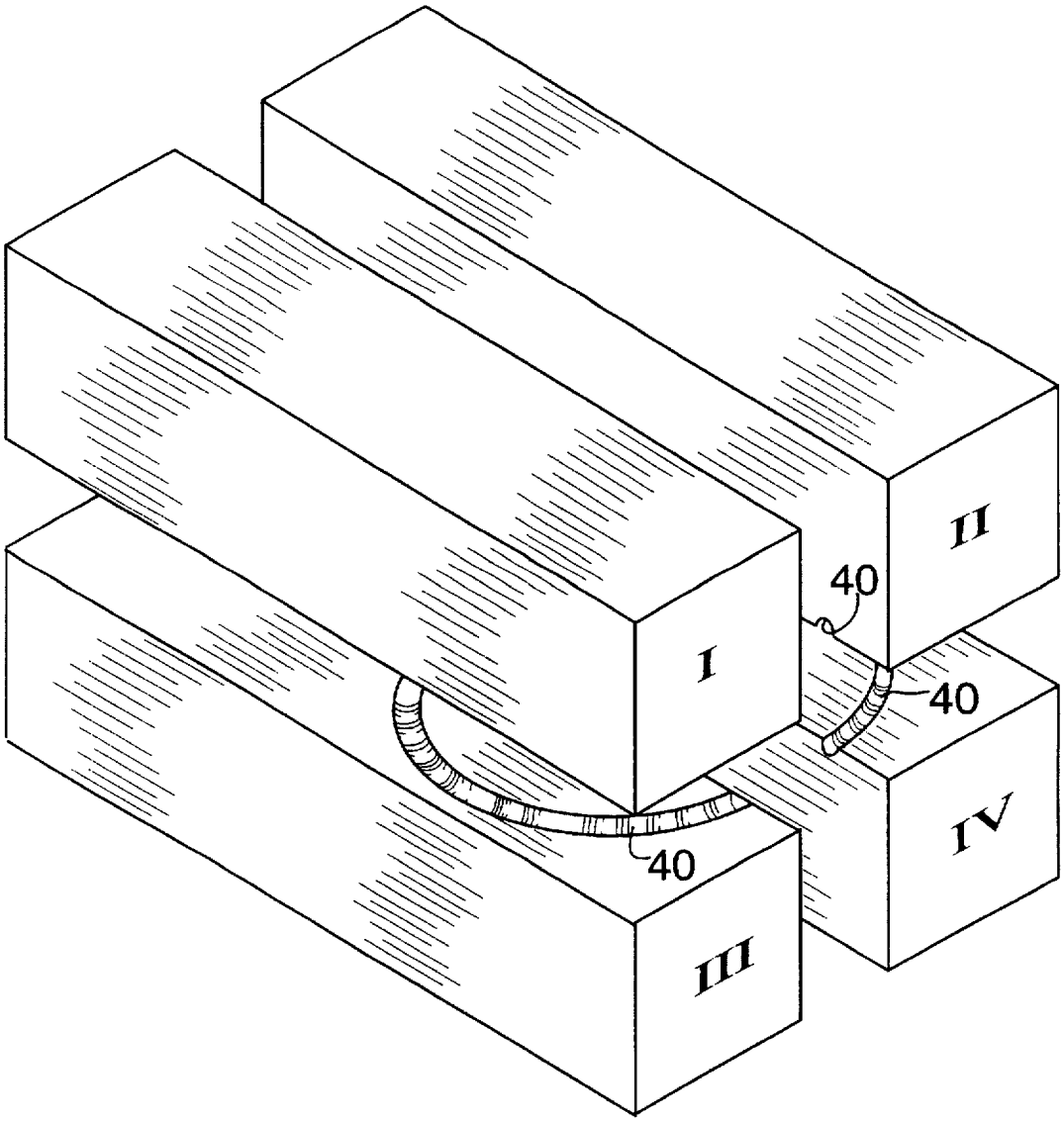
FIG. 6 is a perspective view of a four part mold that may be used to form the retention device.
Figure 7:
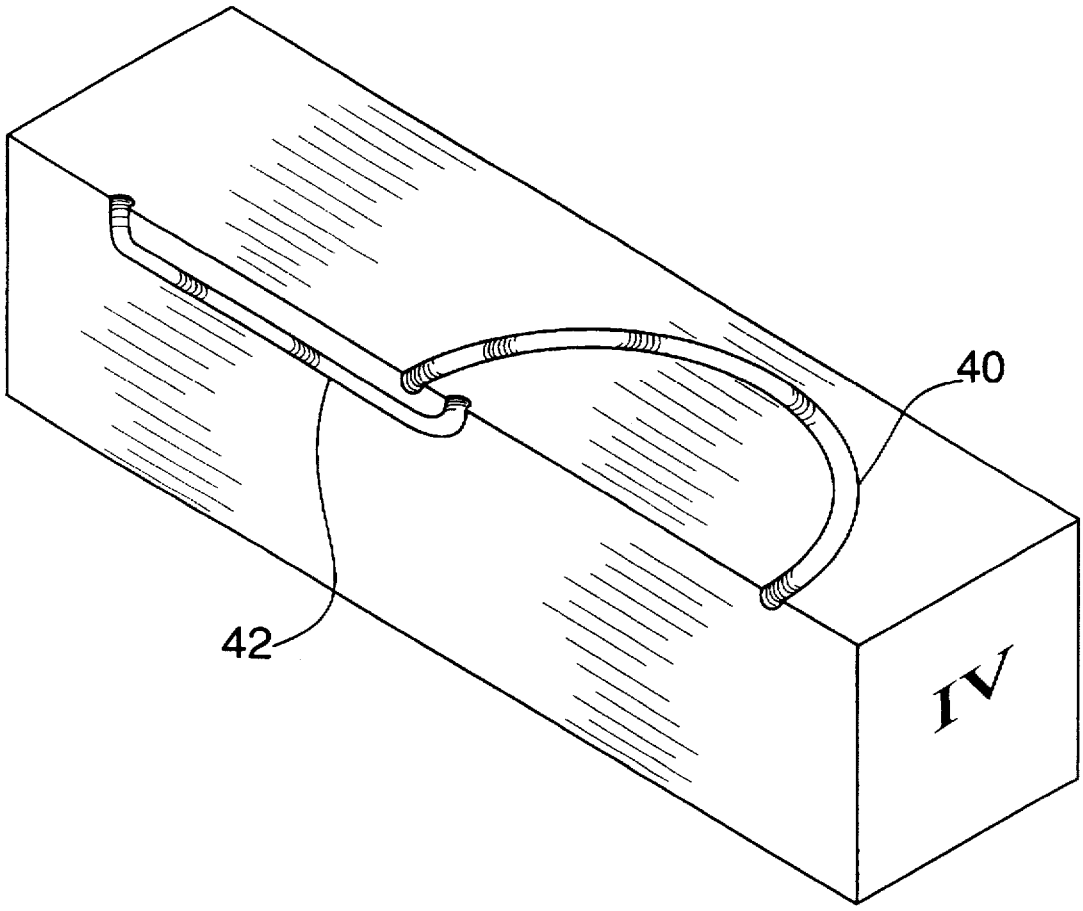
FIG. 7 is a perspective view of one of the four mold sections.

FIG. 6 shows an example of a four-part mold, comprising mold sections I–IV. FIG. 7 shows one of the four parts, section IV, having a cutout channel 40 for the wrist ring and another cutout channel 42, lying in a plane perpendicular to channel 40, for the connecting member. Mold section I is identical to mold section IV, and mold sections II and III are mirror images of mold section IV.

Figure 8:
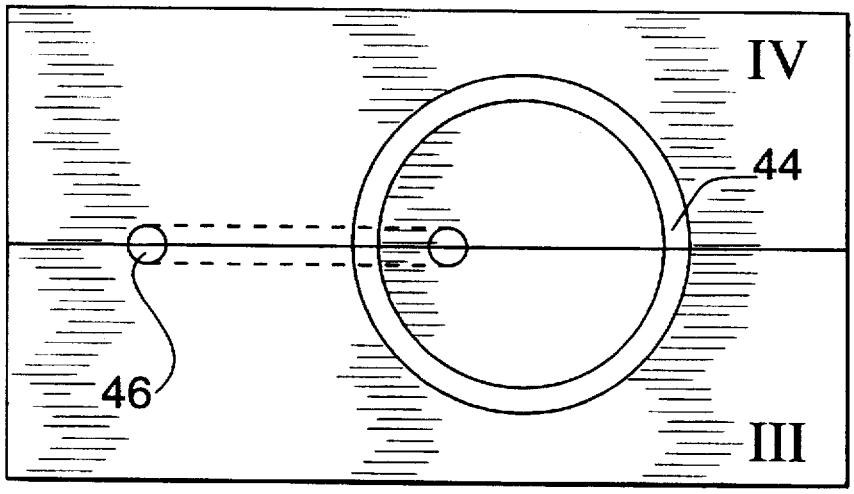
FIG. 8 is a top view of the bottom two mold sections.

As shown in FIG. 8, when the lower two mold sections, III and IV, are placed side-by-side, they form the complete lower half 44 of a wrist ring mold, and the bottom half 46 of the connecting member mold. Thus, when the mirror image mold sections I and II are placed over mold sections III and IV, together they form a complete mold for the wrist ring 12 and connecting member 14.

Figure 9:
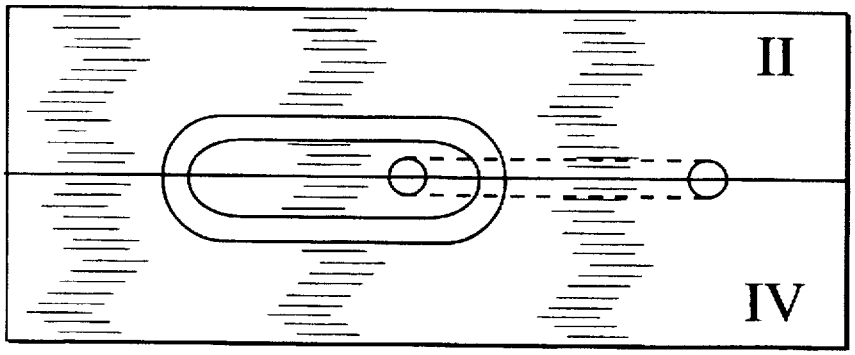
FIG. 9 is a side view of the upper and lower right hand mold sections.
Figure 10:
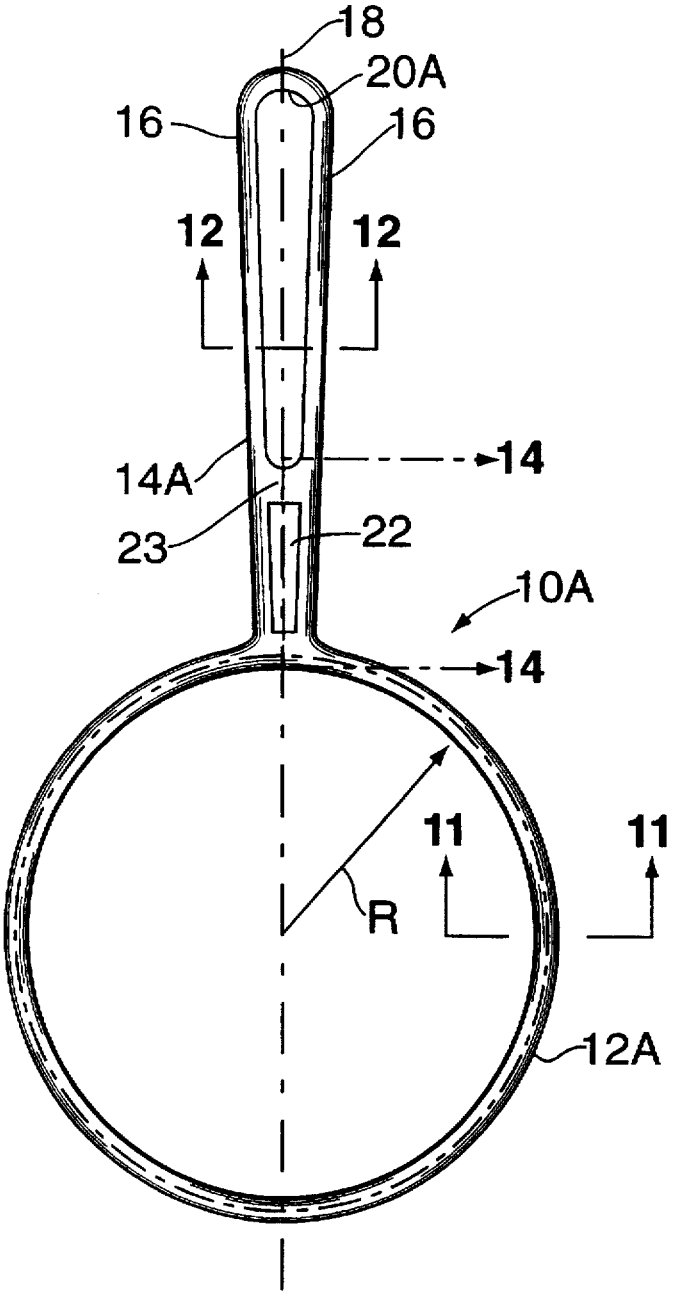
FIG. 10 is a top view of a second embodiment of a retention device.

This is also illustrated by FIG. 9, which shows the upper and lower mold sections II and IV for the right hand side of the mold. As shown, when mold section II is placed over mold section IV, the two sections define the right halves of the two members 12 and 14.

Figure 14:
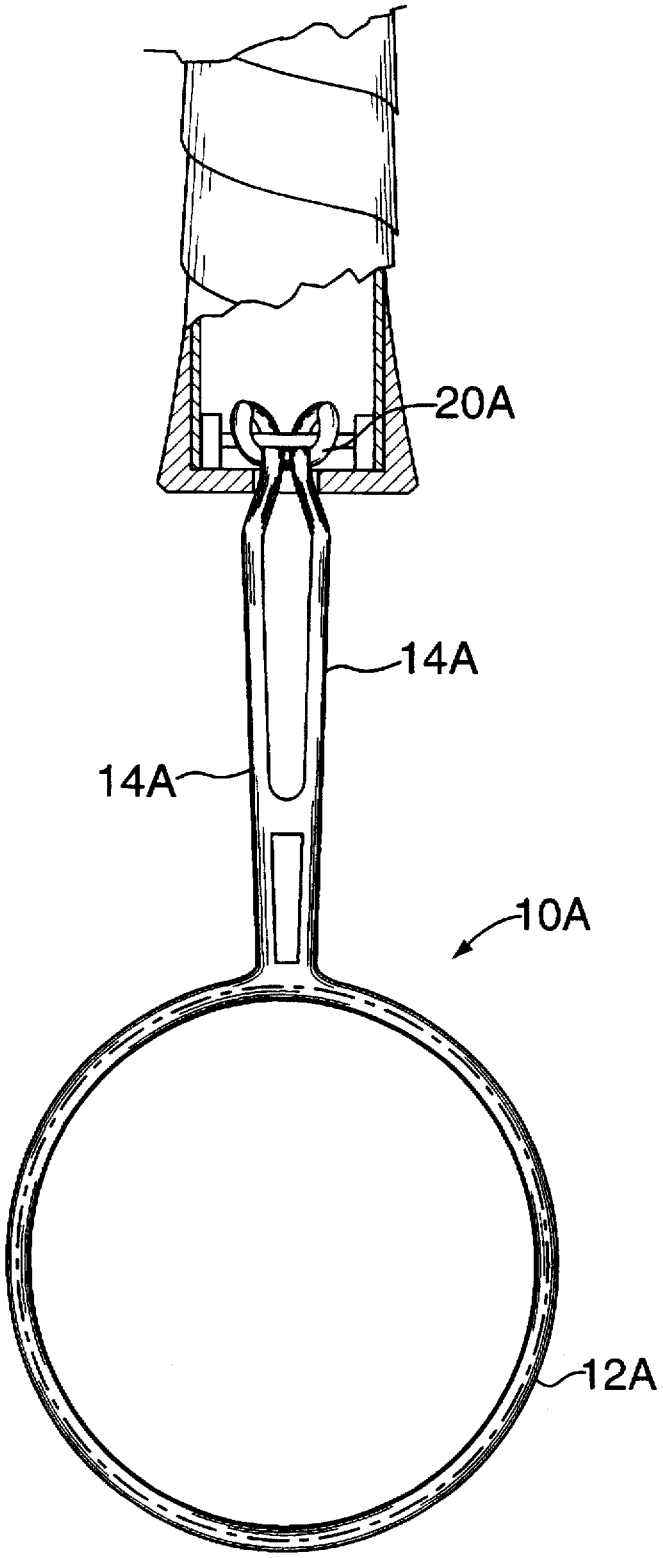
FIG. 14 is a top view of the device, which has been secured to a racquetball racquet handle, the latter shown partly in section.

In a second embodiment, shown in FIGS. 10–14, the retention device 10*a* includes, as the first securing means, a ring 12*a* for fitting about the wrist, and a connecting member 14*a* extending from the ring 12*a*. The connecting member 14*a* includes a pair of arms 16 which extend generally parallel to the longitudinal axis 18 of the device 10*a*, diverging slightly therefrom moving in the direction away from the ring 12*a*. The arms 16 are joined at their extremities by loop portion 20*a*, which is used to connect the device to the racquet in a manner similar to that shown in FIG. 4*b* for loop portion 20, as shown in FIG. 14 (or alternatively, secured as in FIG. 4*a*).

Figure 11:
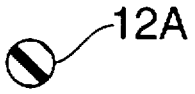
FIG. 11 is an enlarged, sectional view of the device, taken through lines 11—11 of FIG. 10.
Figure 12:
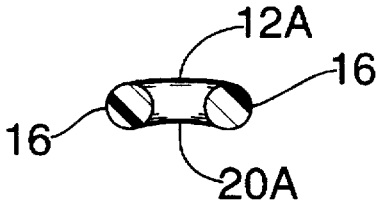
FIG. 12 is an enlarged, sectional view of the device, taken in the direction of lines 12—12 of FIG. 10.
Figure 13:
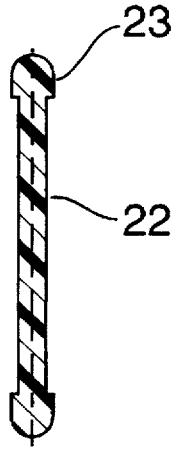
FIG. 13 is an enlarged, sectional view of the device, taken through lines 14—14 of FIG. 10.

The connecting portion 14*a* also includes a web 22 connecting the two arms 16 along a portion of their length. The web 22 can be used to bear a trademark or logo. In the embodiment shown, the ring 12*a* has an inside radius "R" of 38 mm, and a cross-sectional diameter (FIG. 12) of 3 mm. Each of the arms 16 has a cross-sectional diameter (FIG. 13) of 3 mm, and the connecting member 14*a* is approximately 77 mm in length. The ring 12*a* is generally round in cross-section, as shown in FIG. 11, and the arms 16 may also have a generally round cross-section, as shown in FIG. 12.

Preferably, the ring 12*a* and connecting member 14*a* are a unitary piece formed by injection molding an elastomeric material, such as a thermoplastic rubber. A preferred material is Kraton® G-2712, which is a thermoplastic rubber sold by Shell Oil Company. Other preferred materials are natural and silicone rubbers.

In either embodiment, preferably the connecting member 14, 14*a* has a length greater than 65 mm, a tensile strength less than 48 kg, and a spring constant less than 100 kg/m at a pull force of 5.0 kg. The resulting device is substantially extensible, e.g., more than 100% extensibility at 5 kg, and will break if excess pulling force is transmitted from the handle to the wrist, thereby reducing the chance of serious wrist injury.

For purposes of determining how the present retention device would react to impact forces on the wrist compared to conventional racquetball wrist cords, pull tests were conducted in accordance with PSTM-122 String Elongation Test Method at a pull rate of 177.8 mm/minute. The tests were performed on lengths of material having a circular cross-section, which were looped around two one-inch diameter round cylindrical holders in order to impart minimum point pressure. The failure points, and spring constants (measured at 5 kg pull force), were measured as follows:

| Product | Ultimate Tensile Strength | Spring Constant (Force/Distance) |
|---|---|---|
| Nylon Wrist Cord | 95.5 kg | 208.3 |
| Kraton | 20.45 kg | 34.5 |
| Compression Molded Silicone Rubber | 16.45 kg | 32.5 |
| Compression Molded Gum (Natural) Rubber | 6.9 kg | 9.1 (@ 3.5 kg) |

The elongation properties measured as follows:

| | | Elongation (%) Retention Devices Per Invention | | |
|---|---|---|---|---|
| Pull Force (kg) | Standard Wrist Cord | Kraton 2712 | Silicone Rubber | Natural Rubber |
| 0.50 | | 14% | | 33.3% |
| 0.65 | 2% | | | |
| 0.75 | | 28% | | |
| 0.95 | 3% | | | |
| 1.00 | | 41% | 36.2% | 85.2% |
| 1.1 | | | | |
| 1.55 | | | | 149% |
| 2.00 | | 80% | 74.3% | 214.2% |
| 2.05 | | | | |
| 2.50 | 4% | | | 273.8% |
| 3.00 | | 97% | 102.9% | 323.3% |
| 3.10 | 4% | | | |
| 3.50 | | | | 366.6% |
| 3.95 | 5% | | | |
| 4.00 | | 104% | 123.8% | |
| 5.00 | 6% | 109% | 146.2% | |

As shown by the foregoing test, at 5 kg pull force a standard nylon wrist cord has relatively no elongation, whereas the retention devices according to the invention, before reaching 5 kg pull force, have substantial, preferably greater than 100%, elongation. Each of the embodiments of the invention has substantially lower break strength than the conventional nylon wrist cord as well. However, due to the substantial extensibility of the retention device, when the racquet impacts an object it can move relatively freely away from the wrist, and therefore it is unlikely that forces from impact would reach a magnitude, during the game of racquetball, that would approach the break strength.

The foregoing represent preferred embodiments of the invention. Variations and modifications will be apparent to persons skilled in the art, without departing from the inventive concepts disclosed herein. For example, while examples have been given where a loop portion is used to secure the device to a racquet handle pin, any suitable securing mechanism may be employed. All such modifications and variations are intended to be within the skill of the art, as defined in the following claims.

We claim:

1. A racquetball racquet comprising a handle having a butt end, and a retention device comprising wrist securing means for securing said device about a wrist of a person gripping said handle, and a connecting member, coupled to said wrist securing means, wherein said connecting member includes a loop portion, remote from said wrist securing means, for securing said connecting member to said handle, wherein said handle includes a means in the region of said butt end for engaging said loop portion wherein said retention device is made completely of elastomeric material, and wherein said connecting member has sufficient length to allow a person to grip the handle.

2. A racquetball racquet according to claim 1, wherein said wrist securing means comprises a wrist ring sized to fit about the wrist of a person gripping said handle.

3. A racquetball racquet according to claim 2, wherein said ring and connecting member are a unitary piece.

4. A racquetball racquet according to claim 2, wherein said connecting member comprises an elongated closed loop having opposite curved ends connected by a pair of generally straight sections, one curved end engaging said wrist ring and the opposite curved end forming said loop portion.

5. A racquetball racquet according to claim 2, wherein said connecting member has a length greater than 65 mm.

6. A racquetball racquet according to claim 1, wherein the means in the region of said butt end for engaging said loop portion comprises a pin disposed inside said butt end, wherein said loop portion includes a loop end, and wherein said loop portion extends from said loop end around said pin and through said loop end toward said wrist securing means, in order to form a noose around said pin for securing said loop portion.

7. A racquetball racquet comprising a handle having a butt end, and a retention device comprising a wrist ring sized to fit about the wrist of a person gripping said handle, and a connecting member, coupled to said wrist wring, wherein said connecting member includes a loop portion, remote from said wrist securing means, for securing said connecting member to a handle, wherein at least said connecting member is elastic and has sufficient length to allow a person to grip the handle, wherein said handle includes a means for engaging said loop portion, and wherein said connecting means has a tensile strength less than 48 kg so as to reduce the chance of serious wrist injury in the event of substantial force being imparted to the racquet.

8. A racquetball racquet according to claim 7, wherein said connecting member has a spring constant less than 100 kg/m, and an elongation greater than 100%, at a pull force of 5.0 kg, so as to be substantially extensible so as to reduce the chance of serious wrist injury in the event of substantial force being imparted to the racquet.

9. A racquetball racquet comprising a handle having a butt end, and a retention device comprising a wrist ring sized to fit about the wrist of a person gripping said handle, and a connecting member, coupled to said wrist wring, wherein said connecting member includes a loop portion, remote from said wrist securing means, for securing said connecting member to a handle, wherein at least said connecting member is elastic and has sufficient length to allow a person to grip the handle, wherein said handle includes a means for engaging said loop portion, and wherein said connecting means has a spring constant less than 20 kg/m at a pull force of 5.0 kg, so as to be substantially extensible so as to reduce the chance of serious wrist injury in the event of substantial force being imparted to the racguet.

10. A retention device for use with an object having a handle, comprising wrist securing means for securing said device about a wrist of a person gripping the handle, and a connecting member, coupled to said wrist securing means, wherein said connecting member includes a loop portion, remote from said wrist securing means, for securing said connecting member to a handle, wherein said retention device is made completely of elastomeric material, and wherein said connecting member has sufficient length to allow a person to grip the handle.

11. A retention device according to claim 10, wherein said wrist securing means comprises a wrist ring sized to fit about the wrist of a person gripping the handle.

12. A retention device according to claim 11, wherein said wrist ring and connecting member are a unitary piece.

13. A retention device according to claim 11, wherein said connecting member comprises an elongated closed loop having opposite curved ends connected by a pair of generally straight sections, one curved end engaging said wrist ring and the opposite curved end forming said loon portion.

14. A retention device according to claim 11, wherein said connecting member has a length greater than 65 mm.

15. A retention device according to claim 1, wherein said connecting member has a tensile strength less than 48 kg, and an elongation greater than 100%, so as to reduce the chance of serious wrist injury in the event of substantial force being imparted to the object.

16. A retention device according to claim 15, wherein said connecting member has a spring constant less than 100 kg/m at a pull force of 5.0 kg, so as to be substantially extensible so as to reduce the chance of serious wrist injury in the event of substantial force being imparted to the object.

17. A retention device according to claim 1, wherein said connecting member has a spring constant less than 100 kg/m at a pull force of 5.0 kg, so as to be substantially extensible so as to reduce the chance of serious wrist injury in the event of substantial force being imparted to the object.

* * * * *